US009711882B2

(12) United States Patent
Brar et al.

(10) Patent No.: US 9,711,882 B2
(45) Date of Patent: Jul. 18, 2017

(54) PRINTED CIRCUIT BOARD MOUNTED TERMINAL HEADERS

(71) Applicant: Lear Corporation, Southfield, MI (US)

(72) Inventors: Parminder Brar, Windsor (CA); Bhupinder Rangi, Novi, MI (US); David Menzies, Linden, MI (US)

(73) Assignee: Lear Corporation, Southfield, MI (US)

( * ) Notice: Subject to any disclaimer, the term of this patent is extended or adjusted under 35 U.S.C. 154(b) by 0 days.

(21) Appl. No.: 14/676,769

(22) Filed: Apr. 1, 2015

(65) Prior Publication Data

US 2016/0294085 A1 Oct. 6, 2016

(51) Int. Cl.

| | |
|---|---|
| ***H01R 4/50*** | (2006.01) |
| ***H01R 12/73*** | (2011.01) |
| ***H01R 12/70*** | (2011.01) |
| *H01R 103/00* | (2006.01) |
| *H01R 12/58* | (2011.01) |
| *H01R 12/71* | (2011.01) |

(52) U.S. Cl.

CPC ..... *H01R 12/73* (2013.01); *H01R 12/7023* (2013.01); *H01R 12/58* (2013.01); *H01R 12/707* (2013.01); *H01R 12/716* (2013.01); *H01R 2103/00* (2013.01)

(58) Field of Classification Search

CPC H01R 13/514; H01R 13/6215; H01R 13/631; H01R 13/62; H04Q 1/028

USPC ..... 439/345

See application file for complete search history.

(56) References Cited

U.S. PATENT DOCUMENTS

| | | | | |
|---|---|---|---|---|
| 4,469,388 | A | 9/1984 | Narozny | |
| 4,585,288 | A | 4/1986 | Aikens | |
| 4,968,260 | A * | 11/1990 | Ingalsbe | H04Q 1/028 439/638 |
| 5,389,006 | A * | 2/1995 | Noschese | H01R 13/6275 439/354 |
| 5,419,717 | A * | 5/1995 | Abendschein | G02B 6/3817 385/139 |
| 5,452,975 | A * | 9/1995 | Grant | H01R 13/6215 411/22 |
| 5,775,931 | A * | 7/1998 | Jones | H01R 13/631 439/358 |
| 6,056,578 | A * | 5/2000 | Lin | H01R 13/514 439/358 |
| 6,776,533 | B2 * | 8/2004 | Gherardini | G02B 6/3878 385/56 |
| 6,840,789 | B2 * | 1/2005 | Shibata | H01R 13/5202 439/345 |
| 8,529,280 | B2 | 9/2013 | Lim | |
| 8,851,929 | B2 | 10/2014 | Sorani | |
| 2005/0124192 | A1 | 6/2005 | Tang et al. | |
| 2008/0160806 | A1 | 7/2008 | Ma | |

(Continued)

*Primary Examiner* — Jean F Duverne

(74) *Attorney, Agent, or Firm* — MacMillan, Sobanski & Todd, LLC

(57) ABSTRACT

An electrical terminal header assembly is configured for attachment to a substrate and includes a header body having a terminal mounting cavity formed therein and a first locking member. An electrical terminal has a terminal body and a terminal post extending outwardly from the terminal body, is disposed in the terminal mounting cavity, and is retained therein by the first locking member. The terminal post extends outwardly from the header body and is configured for attachment to the substrate.

19 Claims, 8 Drawing Sheets

(56) References Cited

U.S. PATENT DOCUMENTS

2013/0109220 A1* 5/2013 Venema ..... H01R 13/62
439/345

* cited by examiner

PRINTED CIRCUIT BOARD MOUNTED TERMINAL HEADERS

BACKGROUND

This invention relates in general to terminal headers mounted to printed circuit boards (PCBs) of PCB assemblies. In particular, this invention relates to improved male and female terminal headers configured for mounting on different PCBs and configured to mount to each other, wherein electrical terminals are mounted within the male and female terminal headers before the male and female terminal headers are mounted to the PCBs.

Two PCBs may be electrically connected to each other by connecting a male terminal header mounted on a first PCB to a female terminal header mounted on a second PCB. Conventionally, electrical terminals are positioned and held in desired locations on the PCB with an alignment tool during attachment to the PCB, such as with solder. The male and female terminal headers are typically then mounted to the electrical terminals after the electrical terminals have been soldered to the PCB and the alignment tool removed.

The electrical terminals may become bent, misaligned, or otherwise damaged during the mounting of the male and female terminal headers. Also, the male and female terminal headers may be difficult to assemble if they are not aligned properly.

It is therefore desirable to provide improved male and female terminal headers that are easier to align with their corresponding electrical terminals, easier to mount to the PCB, and easier to align with and connect to each other. It is further desirable to provide an improved method of assembling male and female terminal headers on to PCBs that eliminates the need for an alignment tool.

SUMMARY OF THE INVENTION

This invention relates to an improved terminal header for use on a PCB. More specifically, this invention relates to improved male and female terminal headers configured for mounting on different PCBs and configured to mount to each other, wherein electrical terminals are mounted within the male and female terminal headers before the male and female terminal headers are mounted to the PCBs.

An electrical terminal header assembly is configured for attachment to a substrate and includes a header body having a terminal mounting cavity formed therein and a first locking member. An electrical terminal has a terminal body and a terminal post extending outwardly from the terminal body, is disposed in the terminal mounting cavity, and is retained therein by the first locking member. The terminal post extends outwardly from the header body and is configured for attachment to the substrate. Various advantages of the invention will become apparent to those skilled in the art from the following detailed description, when read in view of the accompanying drawings.

DETAILED DESCRIPTION

The present invention will now be described with occasional reference to the specific embodiments of the invention. This invention may, however, be embodied in different forms and should not be construed as limited to the embodiments set forth herein. Rather, these embodiments are provided so that this disclosure will be thorough and complete, and will fully convey the scope of the invention to those skilled in the art.

Figure 1:
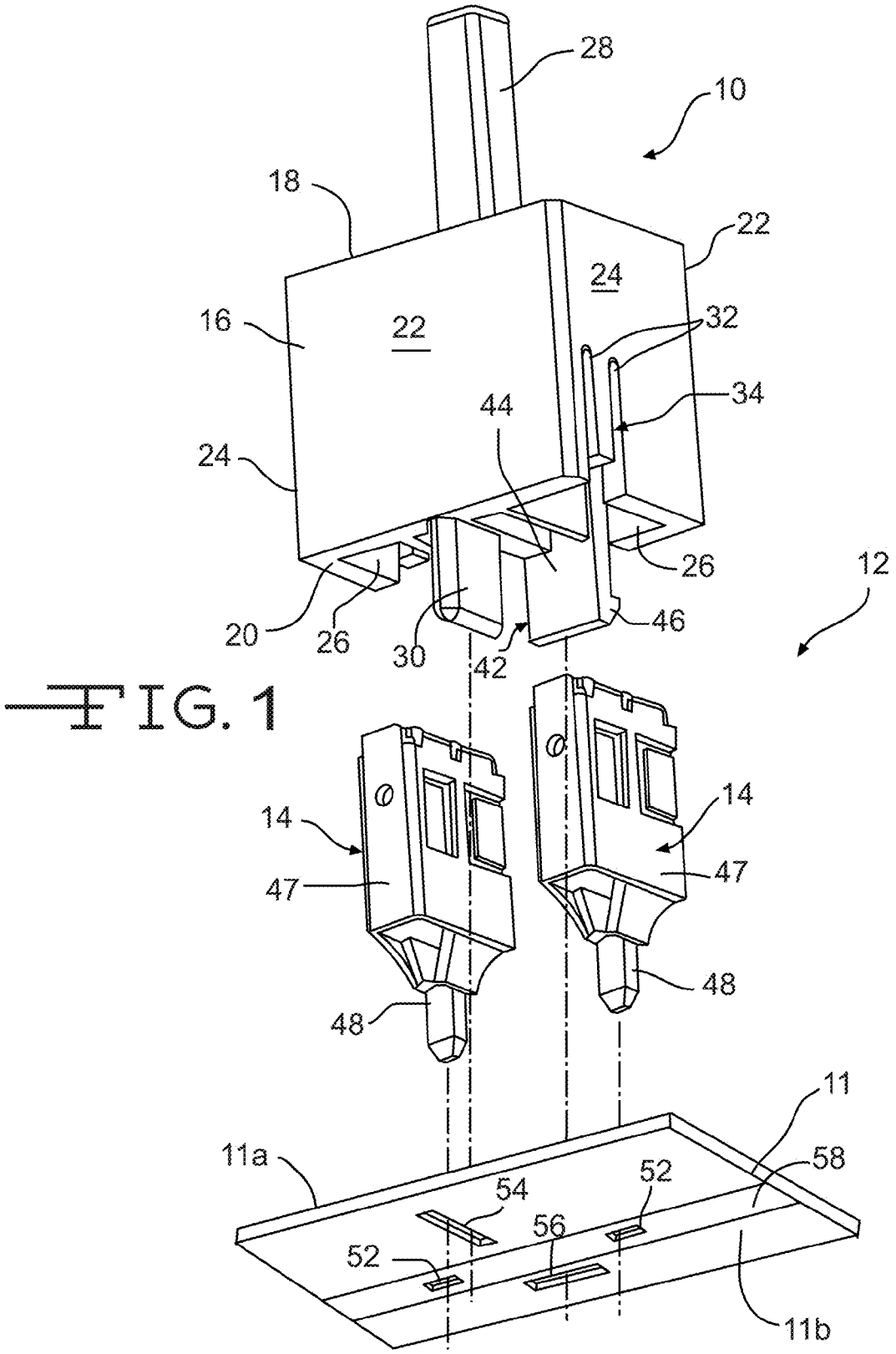
FIG. 1 is an exploded perspective view of an improved female header assembly in accordance with this invention.

Referring now to FIG. 1, there is illustrated at 10 a first printed circuit board (PCB) assembly 10 in accordance with this invention. The first PCB assembly 10 includes a female electrical terminal header assembly 12 mounted to a first PCB 11. The female electrical terminal header assembly 12 includes at least one female electrical terminal 14 mounted within a female header body 16.

The illustrated first PCB 11 is, to the extent shown, representative of a conventional structure for a PCB. The PCB 11 includes a first surface 11*a* and a second surface 11*b*, and is configured to receive and have mounted thereon the female electrical terminal 14, female header body 16, and any number of additional electrical components (not shown).

As shown in FIGS. 1 through 5, the female header body 16 is a box-shaped structure having a substantially rectangular cross-sectional shape and having a first or mating wall 18 and a second or PCB mounting wall 20 opposite the mating wall 18. Male terminal openings 19 are formed in the mating wall 18. A pair of side walls 22 and a pair of end walls 24 extend between the mating wall 18 and the PCB mounting wall 20. Female electrical terminal mounting cavities 26 are formed in the PCB mounting wall 20, and extend through the female header body 16 between the PCB mounting wall 20 and the male terminal openings 19 formed in the mating wall 18. Each terminal mounting cavity 26 is configured to receive and retain one female electrical terminal 14 therein.

A mounting post 28 extends outwardly from the mating wall 18. The illustrated mounting post 28 has a substantially rectangular cross-sectional shape. Alternatively, the mounting post 28 may have any other desired shape, such as substantially cylindrical. The mounting post 28 is configured for connection within a corresponding opening 90 in a male electrical terminal header assembly 62, described below. A PCB guide post 30 extends outwardly from the PCB mounting wall 20. The PCB guide post 30 is configured for connection within a corresponding mounting aperture 54 in the PCB 11, described below. The illustrated PCB guide post 30 has an elongated, substantially rectangular cross-sectional shape and is configured to prevent misalignment of the female header body 16 that may be caused by human error during manual assembly of the female electrical terminal header assembly 12 to the PCB 11. In the illustrated embodiment, the female header body 16 includes one first mounting post 28 and one PCB guide post 30. Alternatively, the female header body 16 may include more than one mounting post 28 and/or more than one PCB guide post 30.

First and second pairs of vertical grooves 32 extend perpendicularly to a plane defined by the PCB mounting wall 20, are respectively formed in the end walls 24, and respectively define a pair of first or terminal locking members 34. Each of the first locking members 34 includes an elongated body 36 and a terminal engaging portion 38 extending inwardly from a distal end of the body 36. A pair of second vertical grooves 40 is formed in at least one of the side walls 22 and defines a second or PCB locking member 42. The second PCB locking member 42 includes an elongated body 44 and a terminal engaging portion 46 extending outwardly from a distal end of the body 44.

The female header body 16 may be formed from any non-electrically conductive material, such as polypropylene, glass filled polypropylene, liquid crystal polymers (LCPs), and other high temperature thermoplastics.

Each female electrical terminal 14 includes a terminal body 47, a terminal post 48 extending outwardly from a first end thereof, and a male terminal receiving aperture 50 formed in a second end thereof. The female electrical terminals 14 may be formed from any electrically conductive material, such as copper and brass.

Figure 3:
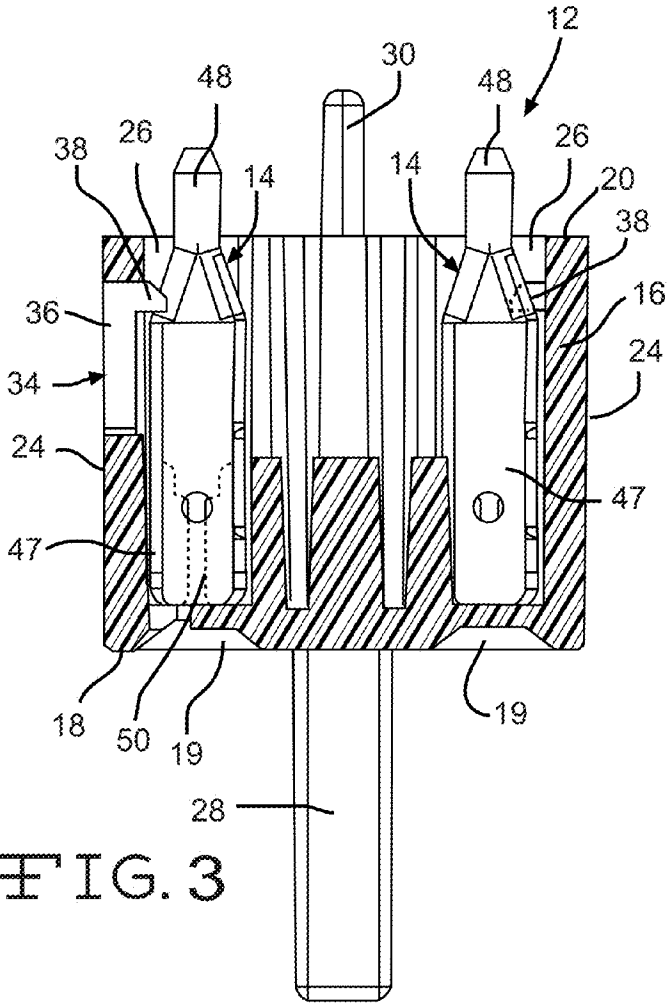
FIG. 3 is a cross-sectional view taken along the line 3-3 of FIG. 2.
Figure 2:
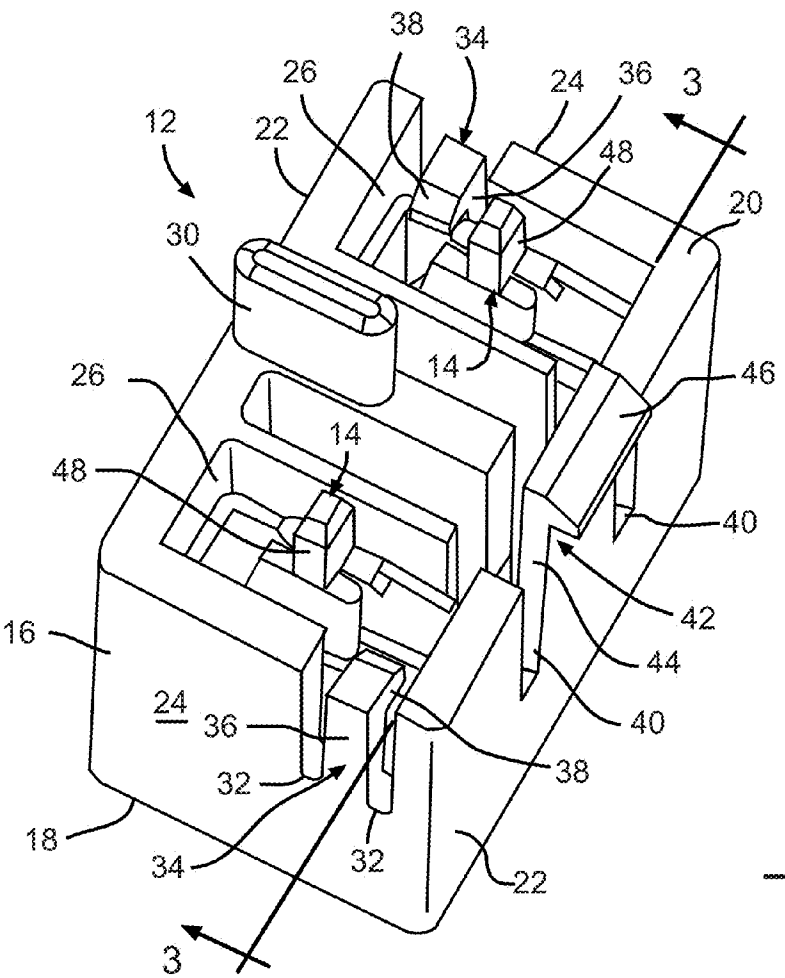
FIG. 2 is a perspective view from below of the female header assembly illustrated in FIG. 1.

To assemble the female electrical terminal header assembly 12, the female electrical terminals 14 are inserted into the terminal mounting cavities 26 in the female header body 16. The female electrical terminals 14 are retained within the terminal mounting cavities 26 in a snap-fit arrangement by the terminal engaging portions 38 of the locking members 34, as best shown in FIGS. 2 and 3.

Figure 5:
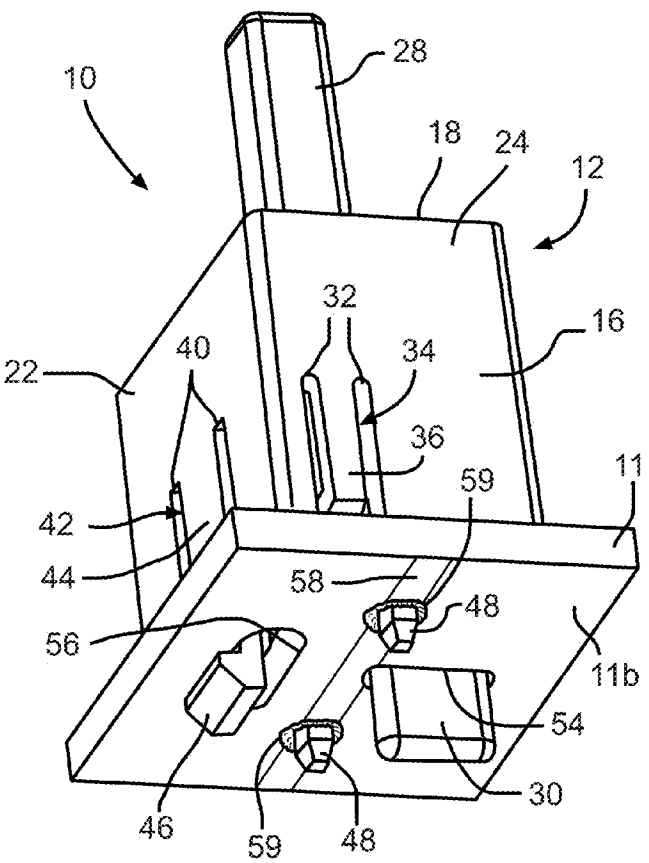
FIG. 5 is a perspective view from below of the improved female header assembly mounted to the PCB illustrated in FIGS. 1 and 4.
Figure 4:
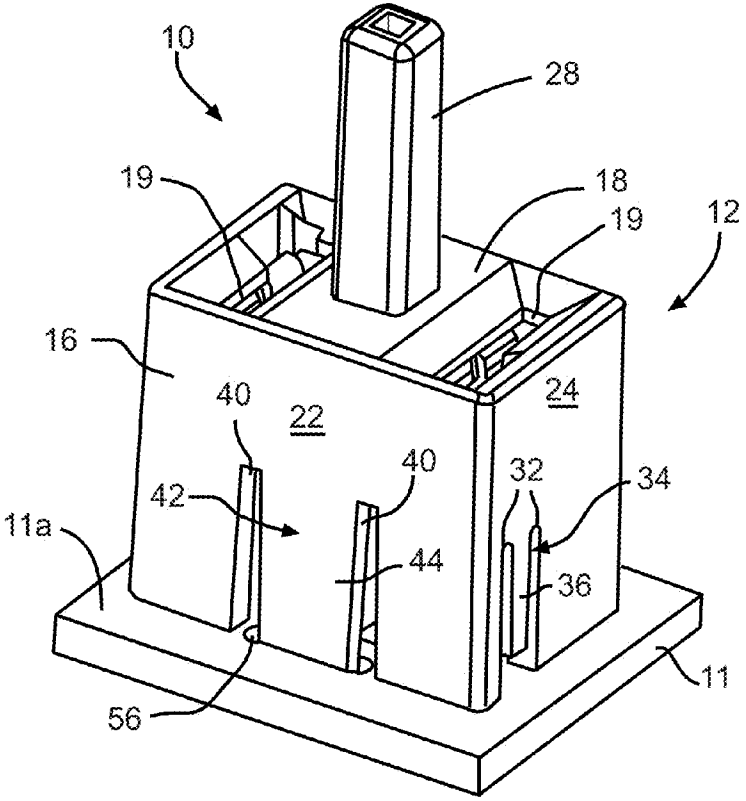
FIG. 4 is a perspective view of the improved female header assembly mounted to the PCB illustrated in FIG. 1.

The female electrical terminal header assembly 12 may then be mounted to the first PCB 11 by inserting the terminal posts 48 into post apertures 52, inserting the PCB guide post 30 into the mounting aperture 54, and inserting the PCB locking member 42 into a locking aperture 56 such that the terminal engaging portion 46 engages the second surface 11*b* of the first PCB 11, thus retaining the female electrical terminal header assembly 12 to the PCB 11. Solder 59 may then be applied to the terminal posts 48 and an adjacent electrically conductive trace 58 on the PCB 11, as best shown in FIG. 5.

In the embodiments of the invention illustrated above, the female electrical terminal header assembly 12 is shown mounted to the PCB 11. Alternatively, the female electrical terminal header assembly 12 may be mounted to any substrate or other device to which attachment of the female electrical terminal header assembly 12 is desired.

Figure 6:
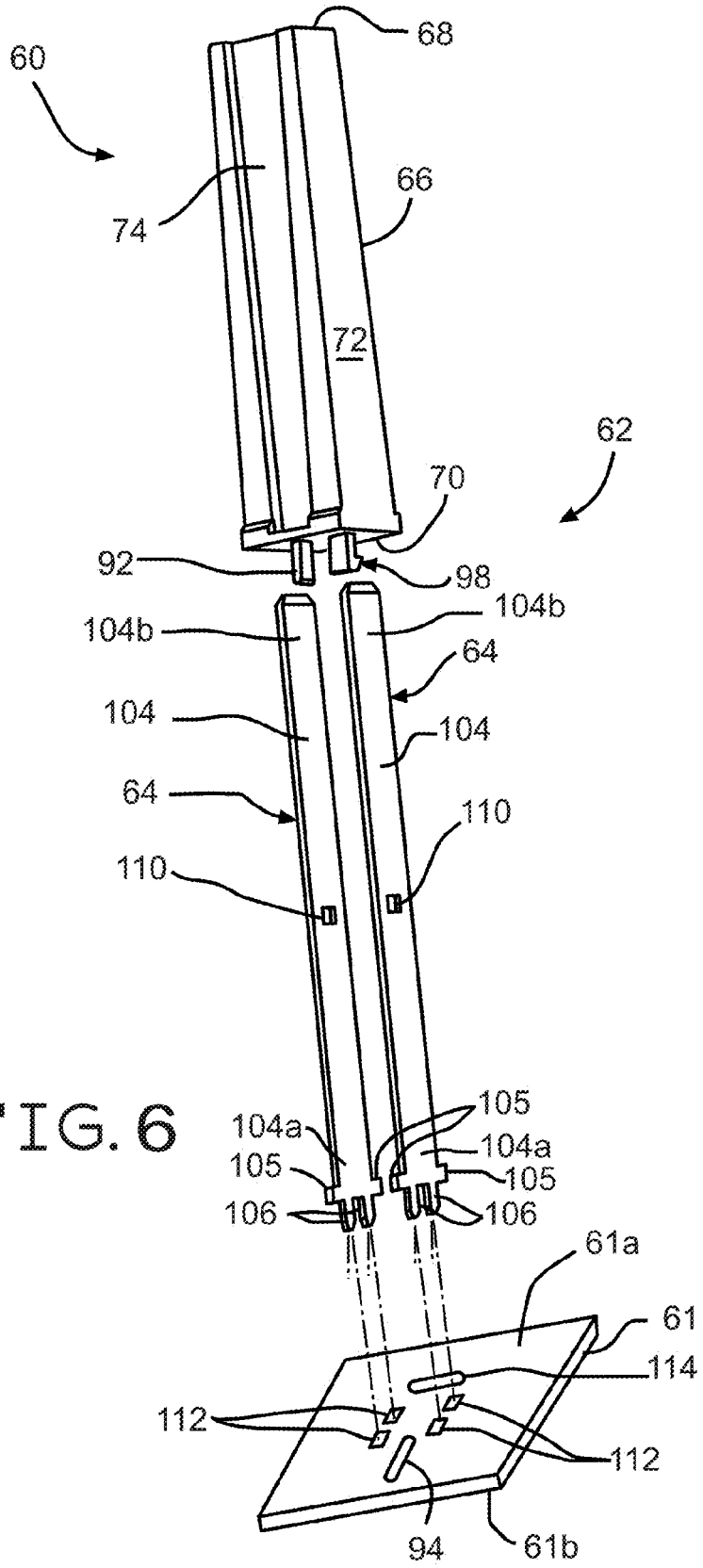
FIG. 6 is an exploded perspective view of an improved male header assembly in accordance with this invention.
Figure 8:
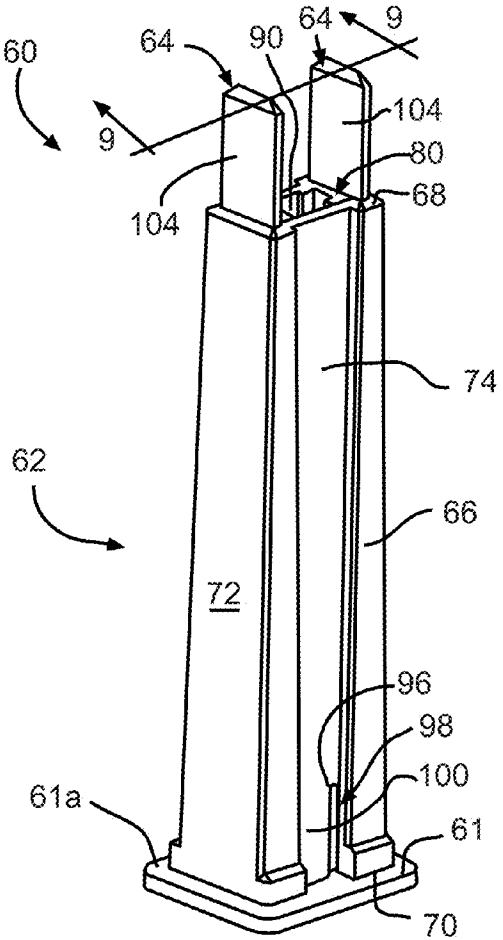
FIG. 8 is a perspective view of the improved male header assembly mounted to the PCB illustrated in FIG. 6.
Figure 7:
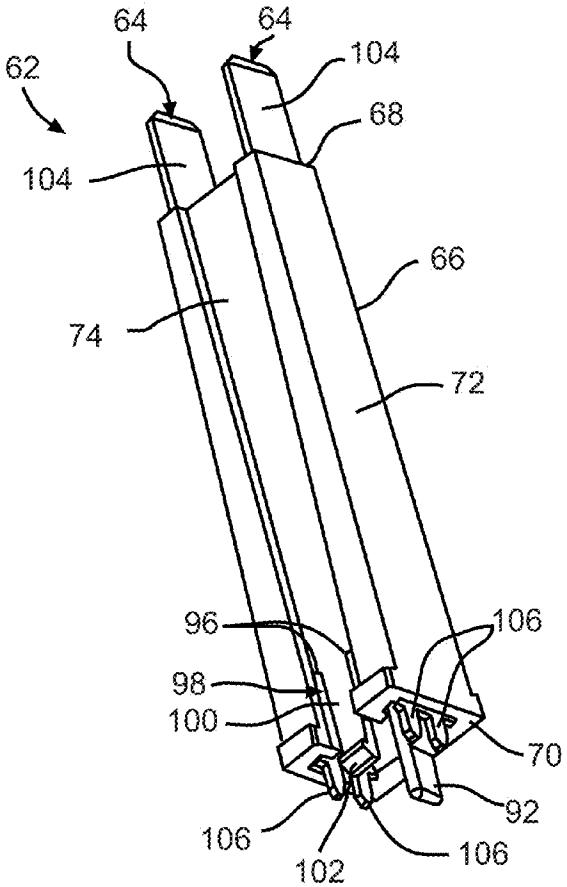
FIG. 7 is a perspective view of the male header assembly illustrated in FIG. 6.

Referring now to FIG. 6, there is illustrated at 60 a second PCB assembly 60 in accordance with this invention. The second PCB assembly 60 includes a male electrical terminal header assembly 62 mounted to a second PCB 61. The male electrical terminal header assembly 62 includes at least one male electrical terminal 64 mounted within an elongated, box-shaped male header body 66.

The illustrated second PCB 61, like the first PCB 11 is, to the extent shown, representative of a conventional structure for a PCB. The PCB 61 includes a first surface 61*a* and a second surface 61*b*, and is configured to receive and have mounted thereon the male electrical terminal 64, the male header body 66, and any number of additional electrical components (not shown).

As shown in FIGS. 6 through 11, the male header body 66 includes a first or mating end 68 and a second or PCB mounting end 70 opposite the mating end 68. A pair of first side walls 72 and a pair of second side walls 74 extend between the mating end 68 and the PCB mounting end 70.

A terminal locking device 80 is formed within male header body 66 at the mating end 68 thereof. The terminal locking device 80 includes longitudinally extending first or terminal locking members 82. Each terminal locking member 82 has a first end 82*a* at the mating end 68 of the male header body 66 and a second end 82*b* that extends toward the PCB mounting end 70. Each terminal locking member 82 includes a terminal engagement portion 84 that extends outwardly from the second end 82*b* thereof and toward the first side wall 72.

The terminal locking members 82 extend longitudinally along an inside surface of the first side walls 72 and define one wall of male electrical terminal mounting channels 86, which are configured to receive and retain the male electrical terminals 74 therein. Each terminal locking member 82 includes a reinforcement flange 88 that extends inwardly at a location intermediate the first end 82*a* and the second end 82*b* of the terminal locking member 82. A space between the terminal locking members 82 defines an opening 90 configured to receive the mounting post 28 of the female electrical terminal header assembly 12.

In the illustrated embodiment, the terminal locking device 80 is integrally formed with the male header body 66. Alternatively, the terminal locking device 80 may be separately formed and attached to the male header body 66 by any desired means, such as by welding or with an adhesive.

A PCB mounting post 92 extends outwardly from the PCB mounting end 70. The PCB mounting post 92 is configured for connection within a corresponding mounting aperture 94 in the PCB 61, described below. The illustrated PCB mounting post 92 has an elongated, substantially rectangular cross-sectional shape and, like the PCB guide post 30, is configured to prevent misalignment of the male header body 66 that may be caused by human error during manual assembly of the male electrical terminal header assembly 62 to the PCB 61. In the illustrated embodiment, the male header body 66 includes one PCB mounting post 92. Alternatively, the male header body 66 may include more than one PCB mounting post 92.

A reinforcing rib 93 may be formed on an inside surface of one of the second side walls 74. The reinforcing rib 93 has a first end 93*a* and a second end 93*b*. The first end 93*a* is connected to the PCB mounting post 92 and extends longitudinally inwardly along the second side wall 74 within the male header body 66. The reinforcing rib 93 may have any desired length. In the illustrated embodiment, the second end 93*b* extends to a point intermediate the mating end 68 and the PCB mounting end 70 of the male header body 66. Alternatively, the reinforcing rib 93 may have any other desired length.

Vertical grooves 96; i.e., grooves that are perpendicular to a plane defined by the PCB mounting end 70, are formed in a second side wall 74 and define a second or PCB locking member 98. The PCB locking member 98 includes an elongated body 100 and a terminal engaging portion 102 extending outwardly from a distal end of the body 100.

The male header body 66 may be formed from any non-electrically conductive material, such as liquid crystal polymers (LCPs) and other high temperature thermoplastics.

Each male electrical terminal 64 includes an elongated, substantially flat blade portion or terminal body 104 having a first end 104*a* and a second end 104*b*. A pair of terminal posts 106 extends outwardly from the first end 104*a* thereof, and a flange 105 extends outwardly from each side of the male electrical terminals 64 between the terminal body 104 and the terminal posts 106. A mounting aperture 110 is formed intermediate the first and second ends 104*a* and 104*b*, respectively, of the terminal body 104. The male electrical terminals 64 may be formed from any electrically conductive material, such as copper and brass.

Figure 9:
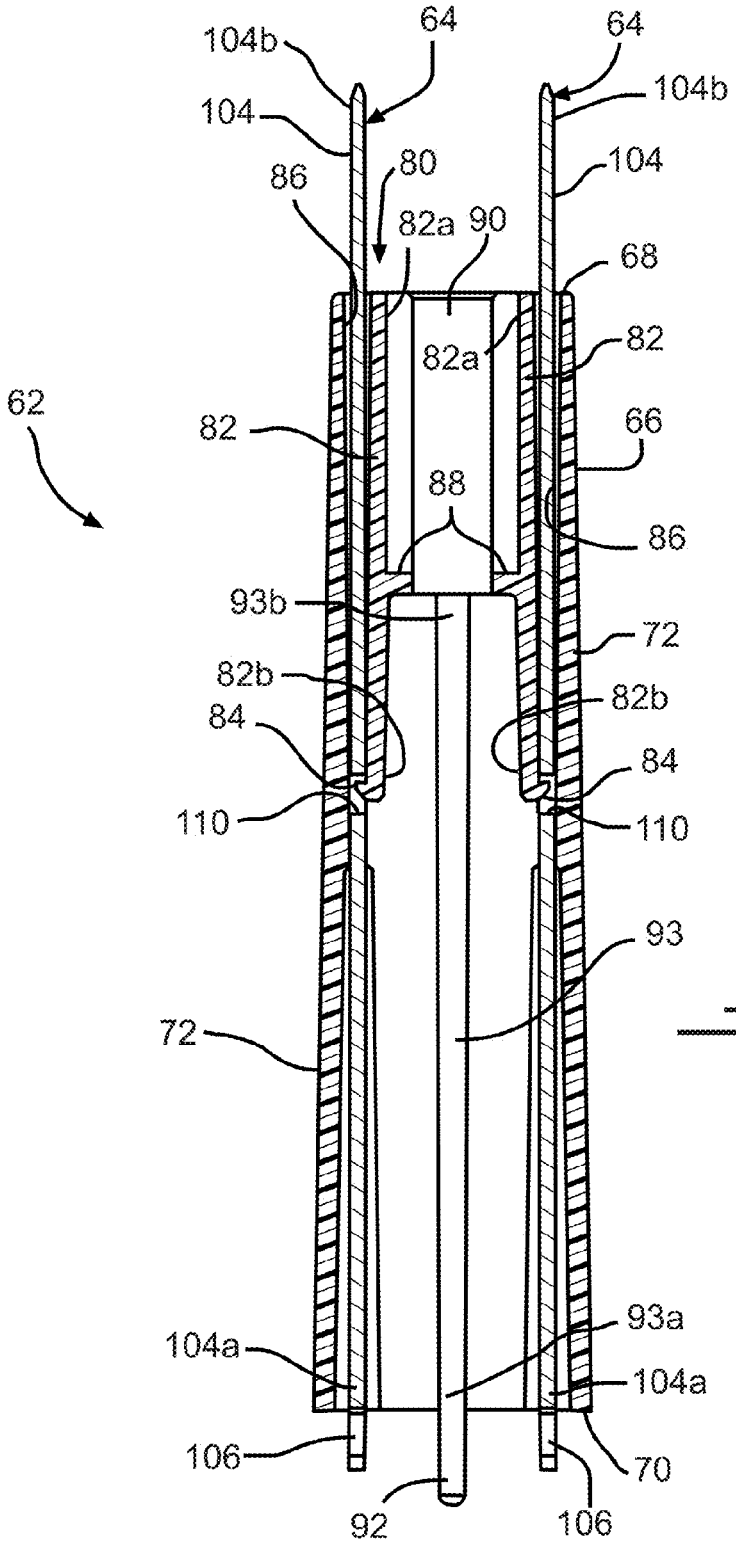
FIG. 9 is a cross-sectional view taken along the line 9-9 of FIG. 8.
Figure 10:
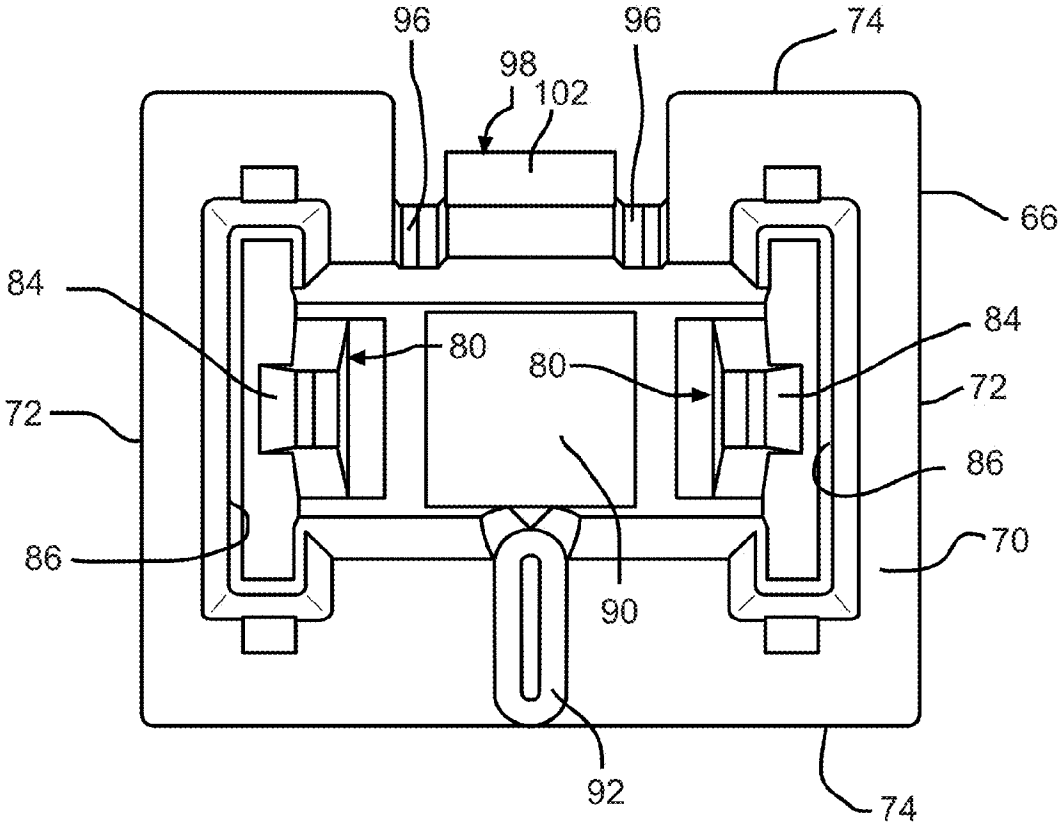
FIG. 10 is a bottom plan view of the male header body illustrated in FIGS. 6 through 9.

To assemble the male electrical terminal header assembly 62, the male electrical terminals 64 are inserted into the terminal mounting channels 86 in the male header body 66 until the terminal engagement portion 84 of the terminal locking member 82 snaps into the mounting aperture 110. The male electrical terminals 64 are thus retained within the terminal mounting channels 86 in a snap-fit arrangement by the terminal engaging portions 84 of the locking members 82, as best shown in FIG. 9.

Figure 11:
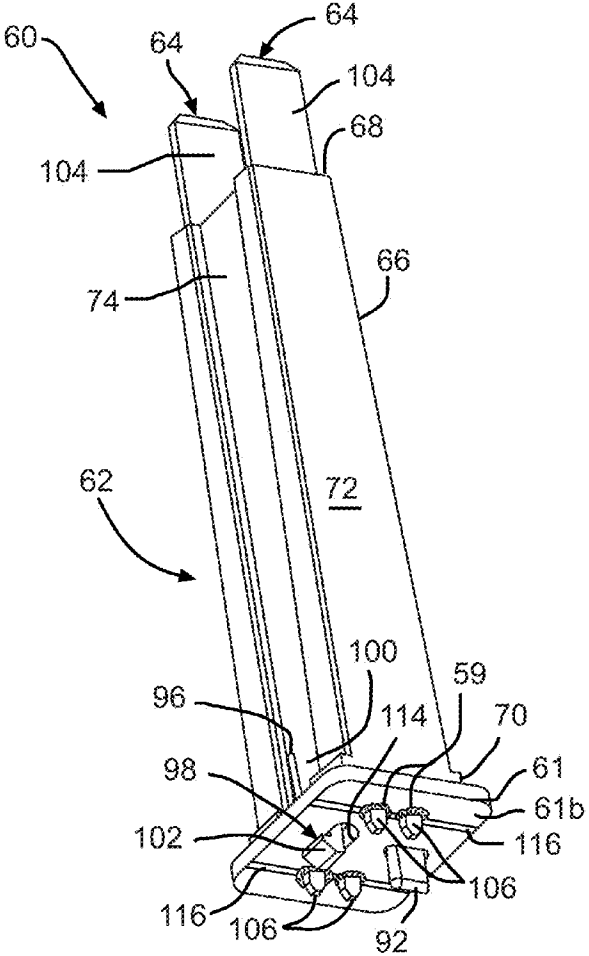
FIG. 11 is a alternate perspective view from below of the improved male header assembly mounted to the PCB illustrated in FIGS. 6 and 8.

The male electrical terminal header assembly 62 may then be mounted to the second PCB 61 by inserting the terminal posts 106 into post apertures 112, inserting the PCB mounting post 92 into the mounting aperture 94, and inserting the PCB locking member 98 into a locking aperture 114 such that the terminal engaging portion 102 engages the second surface 61*b* of the second PCB 61, thus retaining the male electrical terminal header assembly 62 to the PCB 61. Solder 59 may then be applied to the terminal posts 106 and an adjacent electrically conductive trace 116 on the PCB 61, as best shown in FIG. 11.

In the embodiments of the invention illustrated above, the male electrical terminal header assembly 62 is shown mounted to the PCB 61. Alternatively, the male electrical terminal header assembly 62 may be mounted to any substrate or other device to which attachment of the male electrical terminal header assembly 62 is desired.

Figure 12:
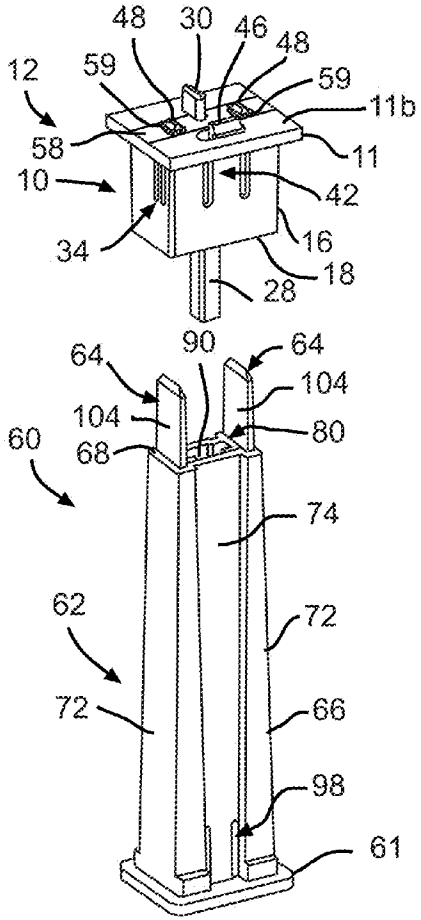
FIG. 12 is an exploded perspective view showing the improved female header assembly aligned with the improved male header assembly prior to attachment thereto.

The female electrical terminal header assembly 12 may then be assembled to the male electrical terminal header assembly 62, as shown in FIG. 12. To assemble the female electrical terminal header assembly 12 to the male electrical terminal header assembly 62, the mating wall 18 of the female electrical terminal header assembly 12 is moved into contact with the mating end 68 of the male electrical terminal header assembly 62 such that the male electrical terminal 64 is inserted into the female electrical terminal 14, and the first mounting post 28 is inserted into the mounting post opening 90.

Both the female electrical terminal header assembly 12 and the male electrical terminal header assembly 62 described herein have advantages over conventional PCB mounted headers. Because the electrical terminals 14 and 64 are mounted within the female header body 16 and the male header body 66, respectively, before being mounted to their respective PCBs, 11 and 61, the header bodies 16 and 66 hold the terminals 14 and 64 in position relative to the PCBs 11 and 61 as solder is applied to the terminals 14 and 64 without the need for a terminal alignment tool. The header bodies 16 and 66 ensure that the terminals 14 and 64 are properly aligned relative to the post apertures 52 and 112, respectively, while being mounted to the PCBs 11 and 61, and also isolate the terminals 14 and 64 from other like terminals when mounted on their respective PCBs 11 and 61.

Additionally, the mounting post 28 of the female electrical terminal header assembly 12 and the post receiving opening 90 of the male electrical terminal header assembly 62 ensure proper alignment when mating the female electrical terminal header assembly 12 to the male electrical terminal header assembly 62.

The principle and mode of operation of the invention have been described in its preferred embodiments. However, it should be noted that the invention described herein may be practiced otherwise than as specifically illustrated and described without departing from its scope.

What is claimed is:

1. An electrical terminal header assembly configured for attachment to a substrate having an opening and an electrically conductive trace, the electrical terminal header assembly comprising:

a header body having a terminal mounting cavity and a first locking member; and an electrical terminal having a terminal body and a terminal post extending outwardly from the terminal body, the electrical terminal disposed in the terminal mounting cavity and retained therein by the first locking member, the terminal post extending outwardly from the header body and configured to extend through an opening in a substrate into electrical contact with an electrically conductive trace provided on the substrate.

2. The electrical terminal header assembly according to claim 1, wherein the electrical terminal is a female electrical terminal having a male terminal receiving aperture.

3. The electrical terminal header assembly according to claim 2, wherein the header body includes a male terminal opening aligned with the male terminal receiving aperture.

4. The electrical terminal header assembly according to claim 1, wherein the header body includes a mounting post that is adapted to cooperate with a second electrical terminal header assembly.

5. The electrical terminal header assembly according to claim 1, further including a guide post configured to extend through a guide post opening in the substrate.

6. The electrical terminal header assembly according to claim 1, further including a second locking member that is configured for attachment to the substrate.

7. The electrical terminal header assembly according to claim 1, wherein the electrical terminal is a male electrical terminal having an opening that is adapted to cooperate with a second electrical terminal header assembly.

8. The electrical terminal header assembly according to claim 7, further including a guide post configured to extend through a guide post opening in the substrate.

9. The electrical terminal header assembly according to claim 7, further including a second locking member that is configured for attachment to the substrate.

10. A method of assembling two electrical terminal header assemblies together, the method comprising:

inserting a female electrical terminal into a female terminal mounting cavity formed in a first header body, thereby defining a first electrical terminal header assembly;

wherein the first header body includes a first locking member and a second locking member; wherein the female electrical terminal has a female terminal body and a terminal post extending outwardly from the female terminal body, the female electrical terminal retained in the female terminal mounting cavity by the first locking member; and wherein the terminal post extends outwardly from the first header body;

mounting the first electrical terminal header assembly to a first substrate by inserting the terminal post of the female electrical terminal into a post aperture formed in the first substrate, and inserting the second locking member in a locking aperture formed in the first substrate;

inserting a male electrical terminal into a male terminal mounting cavity formed in a second header body, thereby defining a second electrical terminal header assembly;

wherein the second header body includes a third locking member and a fourth locking member; wherein the male electrical terminal has a male terminal body and a terminal post extending outwardly from the male terminal body, the male electrical terminal retained in the male terminal mounting cavity by the third locking member; and wherein the terminal post extends outwardly from the second header body;

mounting the second electrical terminal header assembly to a second substrate by inserting the terminal post of the male electrical terminal into a post aperture formed in the second substrate, and inserting the fourth locking member in a locking aperture formed in the second substrate; and inserting the male electrical terminal into the female electrical terminal and inserting a mounting post extending outwardly from a first wall of the first electrical terminal header assembly into a mounting post opening formed in a first wall of the second electrical terminal header assembly, thereby assembling the first electrical terminal header assembly to the second electrical terminal header assembly.

11. A combined assembly of a substrate and an electrical terminal header assembly comprising:

a substrate having an opening and an electrically conductive trace; and an electrical terminal header assembly including (1) a header body having a terminal mounting cavity and a first locking member, and (2) an electrical terminal having a terminal body and a terminal post extending outwardly from the terminal body, the electrical terminal disposed in the terminal mounting cavity and retained therein by the first locking member, the terminal post extending outwardly from the header body and through the opening in the substrate into electrical contact with the electrically conductive trace provided on the substrate.

12. The electrical terminal header assembly according to claim 11, wherein the electrical terminal is a female electrical terminal having a male terminal receiving aperture.

13. The electrical terminal header assembly according to claim 12, wherein the header body includes a male terminal opening aligned with the male terminal receiving aperture.

14. The electrical terminal header assembly according to claim 11, wherein the header body includes a mounting post that is adapted to cooperate with a second electrical terminal header assembly.

15. The electrical terminal header assembly according to claim 11, further including a guide that extends through a guide post opening in the substrate.

16. The electrical terminal header assembly according to claim 11, further including a second locking member that is attached to the substrate.

17. The electrical terminal header assembly according to claim 11, wherein the electrical terminal is a male electrical terminal having an opening that is adapted to cooperate with a second electrical terminal header assembly.

18. The electrical terminal header assembly according to claim 17, further including a guide post that extends through a guide post opening in the substrate.

19. The electrical terminal header assembly according to claim 17, further including a second locking member that is attached to the substrate.

* * * * *